US006393130B1

(12) United States Patent
Stonikas et al.

(10) Patent No.: US 6,393,130 B1
(45) Date of Patent: May 21, 2002

(54) DEFORMABLE, MULTI-MATERIAL HEARING AID HOUSING

(75) Inventors: Paul R. Stonikas, Darien; Robert S. Yoest, Northbrook, both of IL (US)

(73) Assignee: Beltone Electronics Corporation, Chicago, IL (US)

( * ) Notice: Subject to any disclaimer, the term of this patent is extended or adjusted under 35 U.S.C. 154(b) by 0 days.

(21) Appl. No.: 09/356,223

(22) Filed: Jul. 16, 1999

Related U.S. Application Data

(60) Provisional application No. 60/118,261, filed on Feb. 2, 1999, and provisional application No. 60/105,691, filed on Oct. 26, 1998.

(51) Int. Cl.[7] ..... H04R 25/00

(52) U.S. Cl. ..... 381/322; 381/328; 181/135

(58) Field of Search ..... 381/328, 322, 381/324, 380, 326, FOR 133, FOR 135; 181/129, 130, 135

(56) References Cited

U.S. PATENT DOCUMENTS

| | | | | |
|---|---|---|---|---|
| 789,876 A | | 5/1905 | Pape | |
| 1,830,198 A | | 11/1931 | French | |
| 2,521,414 A | | 9/1950 | Schier | |
| 2,535,258 A | | 12/1950 | Bland | |
| 2,908,343 A | | 10/1959 | Hummert | |
| 3,345,737 A | | 10/1967 | Gordon | |
| 3,819,360 A | | 6/1974 | Miller | |
| 3,819,860 A | * | 6/1974 | Miller | 381/380 |
| 4,375,016 A | | 2/1983 | Harada | |
| 4,617,429 A | | 10/1986 | Ballaflorc | |
| 4,716,985 A | * | 1/1988 | Haertl | 181/130 |
| 4,729,451 A | | 3/1988 | Brander et al. | |
| 4,735,759 A | | 4/1988 | Bellafiore | |
| 4,739,512 A | * | 4/1988 | Harti et al. | 381/328 |
| 4,791,819 A | | 12/1988 | Goschke et al. | |
| 4,800,636 A | | 1/1989 | Topholm | |
| 4,834,927 A | | 5/1989 | Birkholz et al. | |
| 4,869,339 A | * | 9/1989 | Barton | 181/130 |
| 4,870,688 A | * | 9/1989 | Voroba et al. | 381/328 |
| 4,871,502 A | | 10/1989 | LeBisch et al. | |
| 4,878,560 A | | 11/1989 | Scott | |

(List continued on next page.)

FOREIGN PATENT DOCUMENTS

| | | |
|---|---|---|
| DE | G1779936 | 10/1959 |
| DE | G79 29224.3 | 10/1979 |
| DE | G79 29226.5 | 10/1979 |
| DE | A1231304 | 12/1979 |
| GB | 2 203 379 A | 10/1988 |
| JP | 61-238198 | 10/1986 |
| JP | 9-65493 | 3/1997 |
| JP | 9-65494 | 3/1997 |
| JP | 10-145896 | 5/1998 |
| WO | WO 93/25053 | 12/1993 |
| WO | WO 99/31934 | 6/1999 |
| WO | WO 99/31935 | 6/1999 |

OTHER PUBLICATIONS

Krogh et al., "Various Types of Earmolds For Profound Hearing Loss", Hearing Aid Fitting, 13th Danavox Symposium, 1988, pp. 429–437.

*Primary Examiner*—Sinh Tran
*Assistant Examiner*—Phylesha Dabney
(74) *Attorney, Agent, or Firm*—Rockey, Milnamow & Katz, Ltd.

(57) ABSTRACT

A compliant hearing aid has a housing formed with an exterior peripheral layer of a deformable material. Electronic components located within the deformable layer can be encapsulated, at least in part, with a second deformable material. The second material also fills voids in the interior of the deformable peripheral layer. The second material can be cured within the deformable layer. Alternately, the second material can be cured apart from the deformable layer. The layer can then be attached to the second material.

44 Claims, 9 Drawing Sheets

U.S. PATENT DOCUMENTS 4,937,876 A 6/1990 Biermans
4,962,537 A 10/1990 Basel et al.
5,002,151 A 3/1991 Oliveria et al.
5,185,802 A 2/1993 Stanton
5,321,757 A 6/1994 Woodfill, Jr.
5,357,576 A 10/1994 Arndt
5,467,775 A * 11/1995 Callahan et al. ..... 181/131
5,530,763 A 6/1996 Aebi et al.
5,531,954 A 7/1996 Heide et al.
5,654,530 A * 8/1997 Sauer et al. ..... 181/130
6,022,311 A * 2/2000 Juneau et al. ..... 181/130
6,052,473 A * 4/2000 Clavadetscher et al. .... 381/322
6,167,141 A * 12/2000 Yoest ..... 381/322
6,228,020 B1 * 5/2001 Juneau et al. ..... 600/25
6,254,526 B1 * 7/2001 Juneau et al. ..... 600/25

* cited by examiner

DEFORMABLE, MULTI-MATERIAL HEARING AID HOUSING

The benefit of the filing date of Feb. 2, 1999 of Provisional Application Serial No. 60-118,261; and Oct. 26, 1998 of Provisional Application Serial No. 60-105,691 are hereby claimed.

FIELD OF THE INVENTION

The invention pertains to deformable hearing aids. More particularly, the invention pertains to such hearing aids that change shape in response to dynamic changes in the shape of a user's ear canal.

BACKGROUND OF THE INVENTION

It has been recognized that, in certain circumstances, hearing aids can significantly improve the quality of life of individuals that have a hearing deficiency. Contemporary hearing aids are often small enough to fit completely into a user's ear canal. Their small size makes them much more acceptable than older more visible aids.

Despite improvements, there continue to be problems with known hearing aids. Two of these problems are comfort and performance. Contemporary in-the-ear hearing aids usually have an exterior housing molded in accordance with the shape of a user's ear and ear canal. Such housings are often formed of rigid plastic such as an acrylic.

The rigidness often results in a less than comfortable fit when in place and can produce discomfort during the insertion and removal process. In extreme cases, usually resulting from ear surgery, the shape of the user's ear or ear canal has been altered such that a conventional hearing aid could not be inserted.

Up to now, there was no economically feasible way to create a soft-shell that was accurately reproducing the ear impression outer features with a designed thickness. Unlike acrylic hard shells that are slushed to a desired thickness, soft elastomeric materials do not easily produce strong and accurate shells. Processes that could be used if they were efficient include Rotomolding, Dipping, and Injection Molding. Those methods are also cumbersome as to prevent high volume manufacture of soft hearing aids.

Performance is an issue with rigid shells in that the shape of the ear canal changes while talking or eating. This change in shape can compromise the seal formed between the shell and the ear canal. Integrity of this seal is important in minimizing external feedback around the shell. This in turn limits the user's usable gain and reduces over-all performance of the aid. Maintaining the integrity of this seal makes it possible to operate the aid at higher gain levels, and better compensate for the user's hearing deficiency providing a higher degree of user satisfaction.

Thus, there continues to be a need for hearing aids that are more comfortable to insert and wear than have heretofore been available. There also continues to be a need for improved performance and higher gain, where appropriate, but without performance degrading external feedback.

SUMMARY OF THE INVENTION

The invention relates to a process for manufacturing a compliant hearing aid starting with an impression of the ear and subsequent creation of a mold that produced a shell of designed shape and size accurately. The process accurately produces a shell that is attachable to a face plate with components creating a soft, ergonomic, compliant, comfortable hearing aid.

A multi-material housing for a hearing aid provides a compliant region which is a reproduction of an impression of a portion of a user's ear canal. When inserted, the housing deforms in accordance with the shape of the ear canal so as to permit comfortable insertion. Once inserted, the reproduced region of the housing sealingly abuts the respective portion of the ear canal so as to provide a seal and prevent feedback. Additionally, the housing deforms in response to deformation of the ear canal as the user moves his or her jaw.

The deformability of the housing makes it possible to mold internal component receiving cavities therein with openings which are too small to permit insertion of the components when the housing is in its normal state. However, in response to a deformation force applied to the respective component, the housing deforms thereby enabling the respective component to slide past the obstruction region and into the premolded component receiving cavity. For example, a receiver could be inserted into a deformable shell at either the audio output end of the shell or at the exterior open end of the shell.

The housing has an external periphery defined by a layer of a first deformable material. The layer of the first deformable material bounds, at least in part, an interior region with an interior surface.

The exterior layer can be molded separately and then filled at least in part, with a compliant filling material. Alternately, an internal, male, mold can be formed which matches the interior surface of the exterior layer. The exterior layer can, in turn, be slid onto the male mold much like a sock can be slid onto the respective wearer's foot.

A sheet member can be incorporated into the housing so as to minimize the possibility of internal feedback when the respective hearing aid is being used. This member can be positioned adjacent to the battery door to block any inflow of liquid interior filling material.

The exterior periphery layer and the interior filling material can be silicone, latex, polyurethane, polyvinyl or any other type of time, heat or U.V. curable elastomer. The preferred hardness of the selected elastomers falls in a range of less than 90 ShoreA.

In a first method of making the housing, a hard plastic shell corresponding to the shape of a user's ear canal is formed by conventional methods. The shell is then attached to a keyed, rigid baseplate and installed in a molding fixture.

Material such as silicone or urethane is poured into the mold. This material will form a female mold which defines the outside surface of a compliant housing.

The mold and the hard shell can be detached from the keyed base and installed in a mold fixture to create a male mold which forms the interior surface of the soft shell. Elastomeric material is poured into the shell to form the male mold or shape. Removing the shell, or template, creates a space between the inner and the outer molds. This space defines the size and shape of the soft shell or outer layer to be formed.

An elastomer such as silicone, polyurethane, polyvinyl or a latex can be poured or injected into the mold space. Once cured the shell can be removed from the mold. An advantage of this process is that the same rigid shell is used to form the exterior, female, and interior, male counterpart molds. Removing the rigid shell produces a space which is an accurate copy of the shell. That space is then filled with the liquid, castable elastomer.

Often times components such as an output transducer, a receiver, are too large to be inserted in the deformable shell or layer without distortion. However, given the deformability of the shell, applying an insertion force to the respective component or components can cause the shell to temporarily change shape or expand thereby permitting the respective component to be slid through a constricted path so as to be appropriately located in an internal cavity of the shell. Remaining spaces in the shell can be filled with a backfilling material, preferably after providing a rigid plastic outer shell around the exterior deformable shell. For example, UV curable plastic can be applied to the deformable shell, and cured whereupon a rigid protective layer is formed around the exterior of the shell. It can then be backfilled with a filling material which is the same or different material without concern that the filling material will distort the desired shape of the shell.

In yet another form of processing, a hard shell, representing a casting of a portion of a user's ear canal is used to create a deformable exterior shell as described above. This shell is then used to create a mold of an interior plug which houses the components.

When filled and cured, the exterior surface of a plug matches the interior surface of the soft shell. That soft shell can then be slid onto the plug. The exterior soft shell can then be attached at one or more regions by glue or the like to the plug. Since the same hard shell was used to create both the exterior deformable soft shell and the interior plug, the two parts match exactly.

In an alternate embodiment, the exterior soft shell or sock can be selectively bonded to the interior plug thereby creating a skin-feel to the surface of the shell. In this instance, the surface of the shell is slightly movable relative to the interior plug.

In yet another aspect, the deformability of the soft shell can be used to advantage during manufacture. When installing components, the components can be pushed through small channels in the shell, by distorting same temporarily. After insertion, the shell returns to its normal shape. This interior can then be filled, at least in part, with a curable deformable material. The material of the shell and the interior material can be the same or different depending on desired characteristics.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
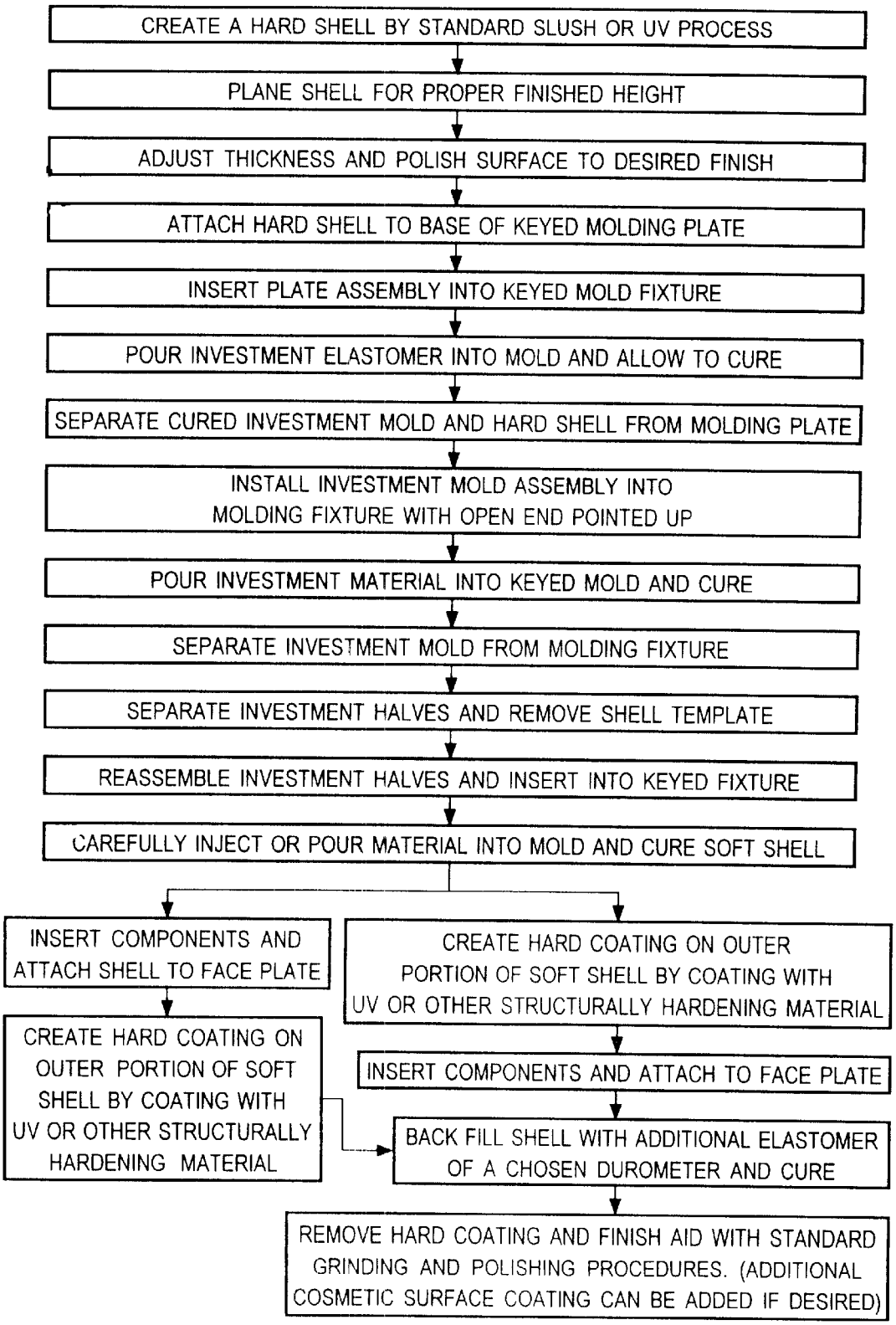
FIG. 1A is a flow diagram of steps in accordance with one processing method.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

The present invention pertains to processes for manufacturing compliant hearing aids. Common steps in the processes disclosed herein include forming an impression of the ear of the user with the hearing deficiency. This is a well-known step in the hearing aid industry. The next common step includes forming a rigid, thin-walled shell which replicates the exterior surface of the impression of the user's ear canal.

The formation of rigid shells, often of acrylic, which replicate a user's ear impression is also well-known in the hearing aid industry. Such shells are often formed of acrylic plastic using a multi-step process wherein a female mold is first formed of the user's ear impression. Acrylic plastic in fluid form is poured into the mold, permitted to cure at the edges of the mold either through heat, radiant energy or time. The fluid plastic in the center of the mold is dumped and the process is repeated several times.

Ultimately, a rigid thin-walled shell or template is created which accurately duplicates the exterior peripheral surface of the impression of the user's ear canal.

Figure 1B:
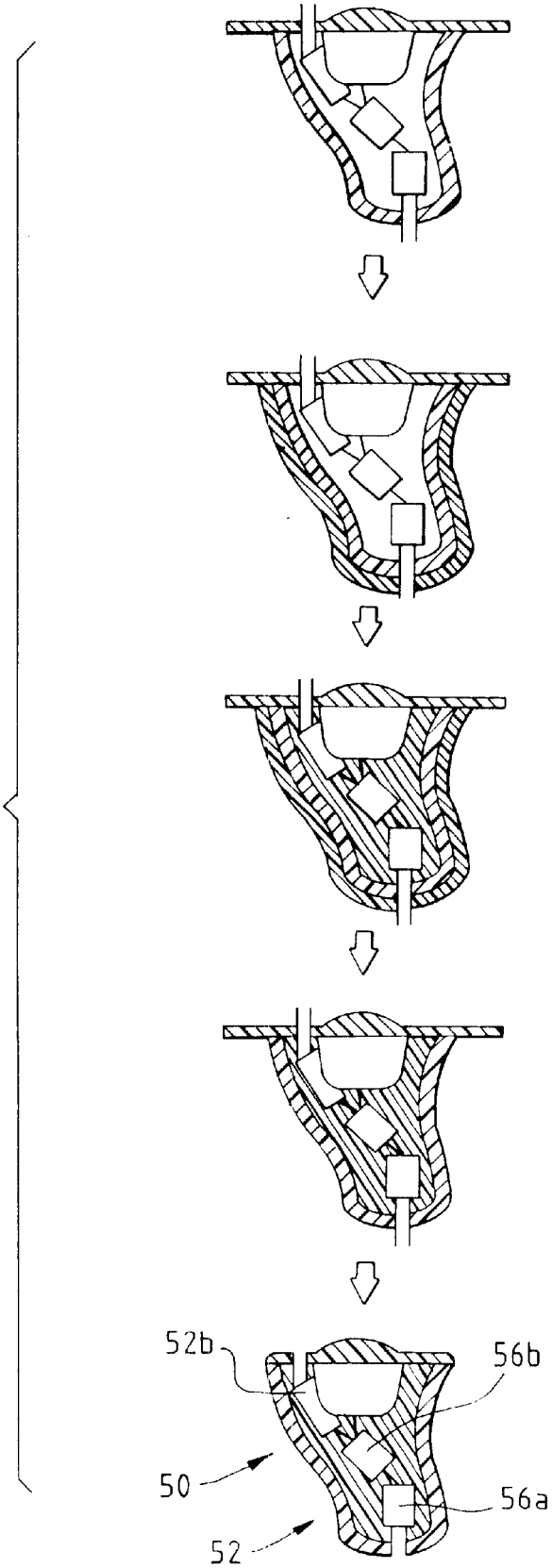
FIG. 1B is a pictorial diagram of some of the steps of FIG. 1A.

With respect to the diagrams of FIGS. 1A, 1B, once a hard template or rigid shell has been created, the following process steps can be used to create an accurately molded compliant shell, whose exterior peripheral surface duplicates the impression of the user's ear canal.

1. Attach the rigid shell to a keyed, plate and install into a molding fixture.

2. Pour an elastomeric material (silicone, urethane, etc.) into the mold and cure. This forms a female mold of the outside surface of the soft-shell.

3. Detach the female mold and rigid shell from the keyed base and install same into a mold fixture to create the male mold. This forms the interior surface of the soft-shell.

4. Pour elastomeric material to form male mold.

The keying feature aligns the internal mold with the external shape. The more accurately aligned the inner and outer molds, the thinner the soft-shell can be made without holes or thin sections. Proper alignment of molds is critical for making small shells where internal space is scarce.

5. Removing the hard shell template creates a space between the inner and outer molds. This space defines the size and shape of the soft-shell to be molded.

6. An elastomer (silicone, urethane, etc.) can be poured or injected into the mold space and cured forming the shell.

7. After curing, the deformable shell is removed from the shell mold.

As an alternate to the above described acrylic shell forming process, a UV-sensitive plastic can be used to create the rigid shell as follows:

1. Attach a sculpted ear impression to a molding fixture and pour in and cure an elastomer that is transparent to UV to form a female mold.

2. Pour a UV curable liquid to the top of the mold and form a rigid shell of a desired thickness. Pour out excess UV material and finish curing the rigid shell.

3. The remaining steps of the process are identical to the process described above, starting with step 4.

The mold to form the soft-shell is created from a hard shell that forms a cavity in the mold representative of the shell. The soft elastomeric material can be injected into the cavity or poured into the female mold and the male mold can be installed after displacing any excess soft-shell material.

Unlike hard shells, soft-shells cannot adequately protect delicate components without additional structure. As described in FIG. 1A and illustrated in FIG. 1B, the components are placed into the soft-shell and sealed to the face plate. A tube can be used to protect the wires between the amplifier and the receiver to insure the presence of slack in the wires and that the wires are not pinched or pulled causing breakage.

The ends of the tube are sealed to the end points using an adhesive such as an RTV. The shell is filled with additional elastomeric material. The material can be identical or can be different from that used to form the outer shell. This process allows for the hardness and feel to be adjusted to the customer needs. The inner fill and the outer shell create a matrix that imparts unique properties.

Example: The outer shell needs to be durable, flexible, have a smooth, uniform surface with appropriate frictional characteristics. It is difficult to find a single material that can provide the proper comfort, durability and acoustic performance. The permutations and combinations of shell material, backed up with other elastomers, provide a great advantage over one-piece constructions.

The back-filling process requires that the battery compartment be sealed so that material used, as back-fill not intrude into those areas. Since current faceplates are not sealed, a shroud or a sheet member, is attached to the face plate sealing the vital areas. The shroud is designed to be as small as possible, thus allowing for smaller hearing aids. Wires are routed through the shroud by way of a sealed tube. The shroud also acts to eliminate an internal feedback path for sound from the receiver.

Back-filling is the process by which the aid is filled, encapsulating the internal components by filling elastomeric material between the components. Once cured, the back-fill provides additional protection to the components and the rigidity required inserting the aid into the ear.

True shell size is maintained through the use of a hard over shell produced by coating the outside of the mold with an UV curable material. When cured, this material has strength which is sufficient to contain the back filling injection pressure without changing the shape or size of the shell.

The process for maintaining true size can be carried out after making the shell. In some cases, there is an advantage of being able to stretch the shell in order to install the receiver in a crooked ear canal. The size can then be frozen. The preferred method would be to freeze the size after making the soft-shell and before attaching it to the face plate.

Using an assembly practice that utilizes the ability of stretching the shell momentarily, components can pass through a tight, normally not accessible cavity, thus utilizing the available space more efficiently. The fact that the shall can stretch to allow the components to pass through into an otherwise not accessible cavity insures that hearing aids can be made even smaller, thus helping a larger number of people with small ear canals.

Figure 2A:
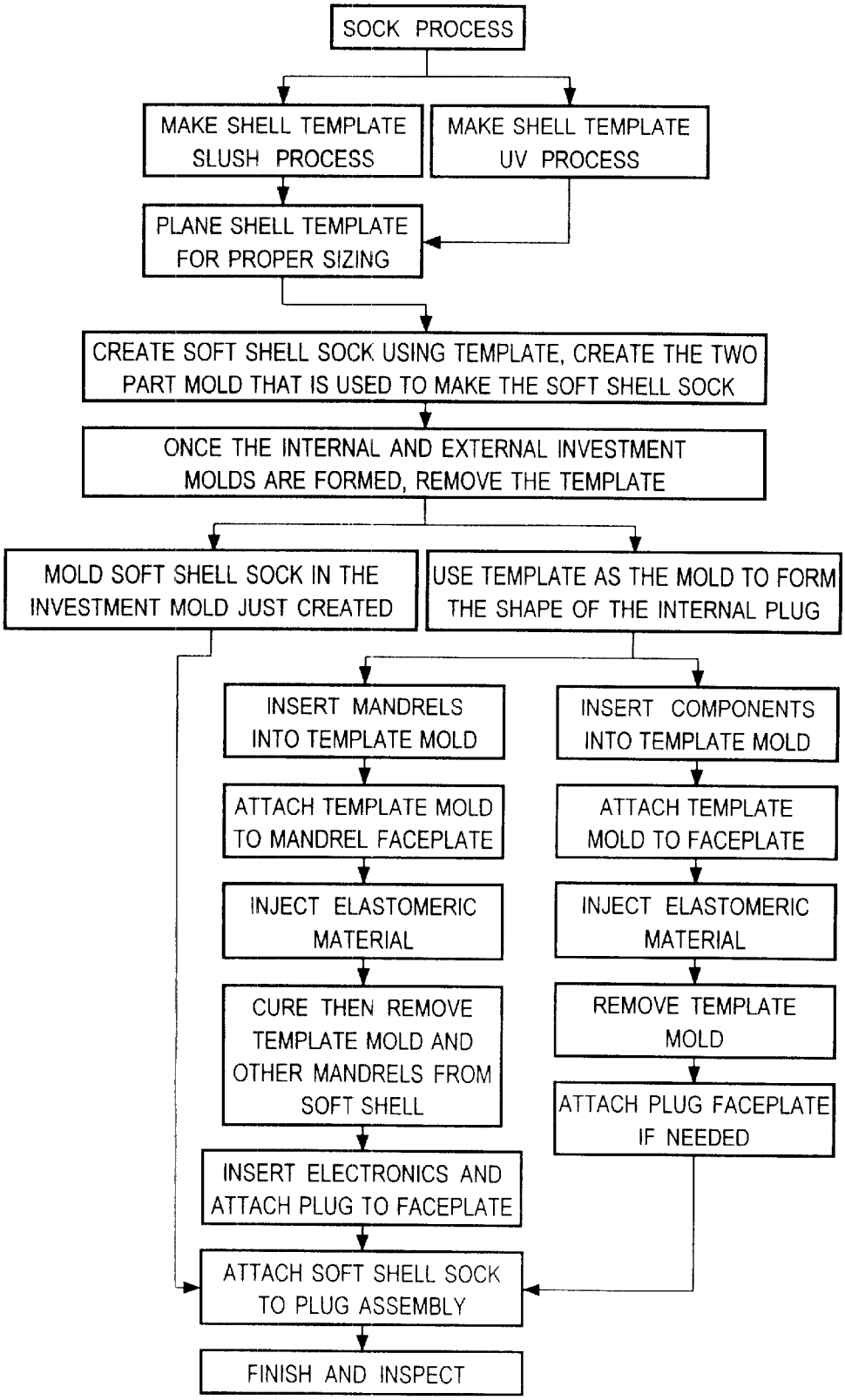
FIG. 2A is a flow diagram of steps in accordance with another processing method.
Figure 2B:
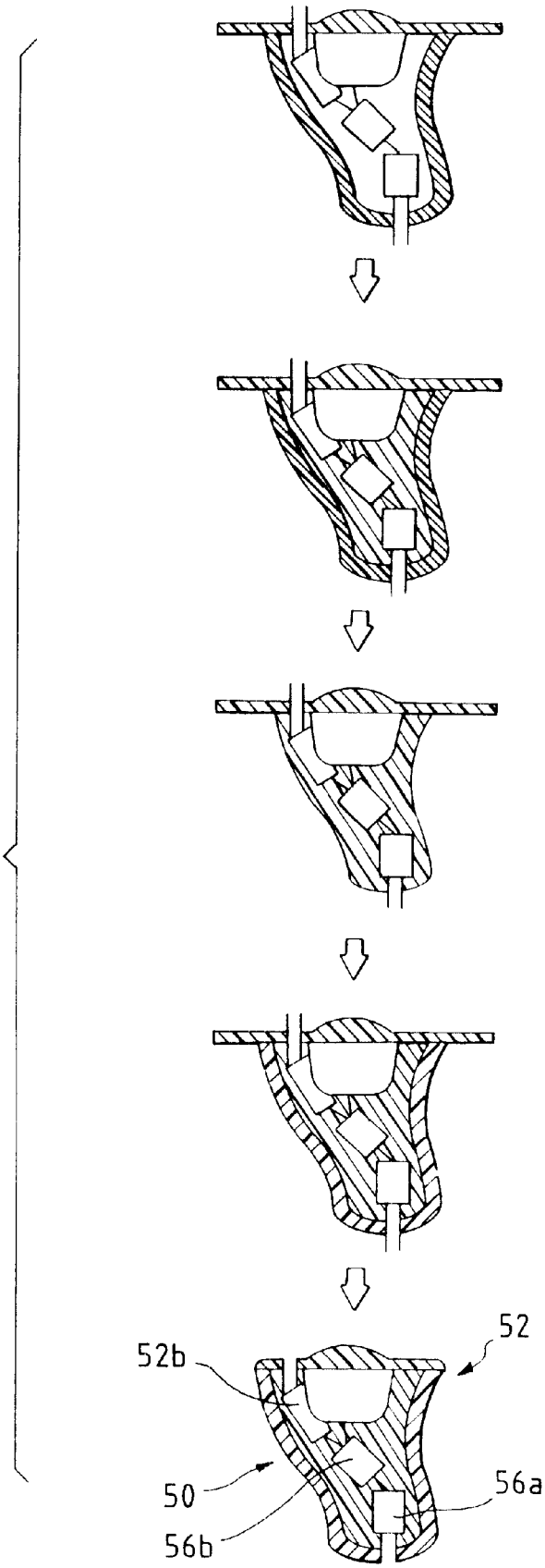
FIG. 2B is a pictorial diagram of some of the steps of FIG. 2A.

The sock process illustrated in FIGS. 2A, 2B, utilizes the same method of making the hard shall or template but the shell is used for two purposes.

1. The rigid shell is used to create the mold that is used to create the soft-shell (sock) as in the process discussed above.

2. The rigid shell is then used to create the mold for the plug that houses the components. When filled and cured, the outside of the plug matches with the interior surface of the soft-shell (sock). The soft-shell is later attached in a gluing process. It matches exactly since the same shell is used to create the soft-shell (sock) mold and the plug mold.

In this process, the internal components are retained in a shape that does not distort the true size of the hearing aid when compared to the original ear impression. Instead of trying to retain the shape of the shell by reinforcing the outside of the soft-shell during a back-fill operation, the template shell insures perfect alignment. The mold can be filled at a higher pressure, thus insuring better filling. In addition, bonding between the sock and the plug can be selective, creating a skin-like feel to the surface of the shell.

Figure 3A:
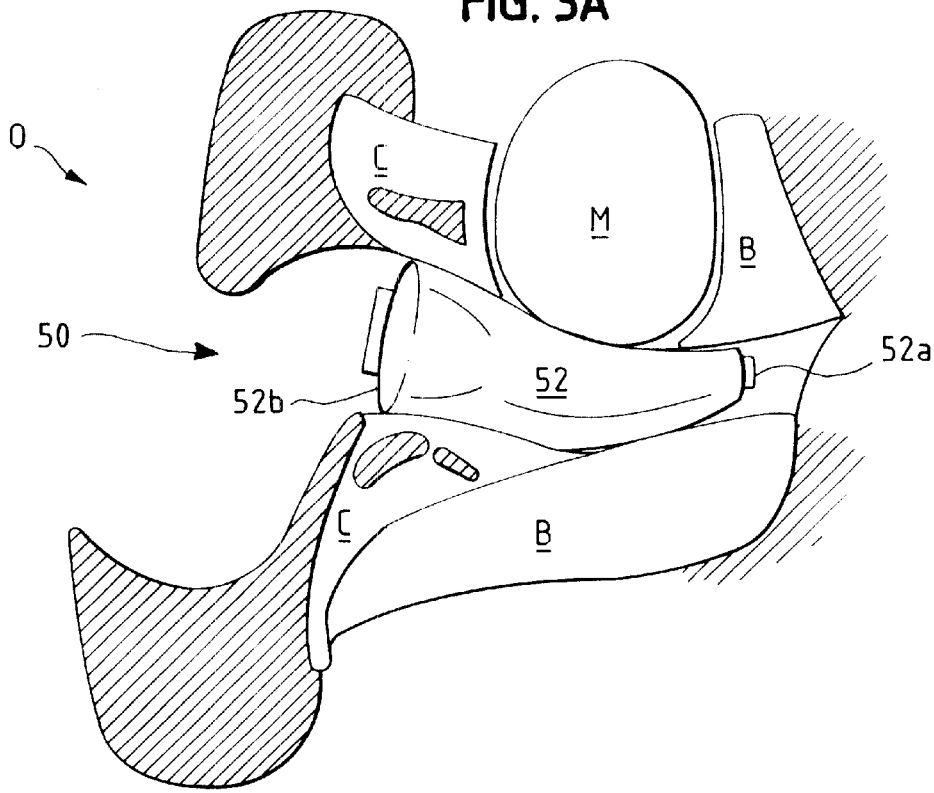
FIG. 3A is an enlarged, partial top view of a user's ear in a quiescent state.

FIG. 3A illustrates a partial top view of the left ear of a user with a hearing aid 50 of the type described above positioned therein. The user's ear includes the outer ear O, an ear canal wherein aid 50 is positioned and a tympanic membrane, ear drum, located at the interior end of the canal.

The hearing aid 50 is formed of a soft compliant housing 52 which fills the portion of the ear canal and seals against the adjacent surfaces thereof. Because the housing 52 is soft and deformable, it can comfortably be inserted into and removed from the ear canal. Surrounding the ear canal and the housing 52 are cartilage C. Skill bone B and a portion M of the mandible of the user's jaw.

The mandible M moves relative to the cartilage C and bone B when the user talks, eats or moves his or her jaw for any reason. This in turn alters the shape of the ear canal. FIG. 3A illustrates the canal and housing in a quiescent state when the jaw is at rest. In this circumstance, the shape of the canal corresponds to the shape of an ear impression of the canal such as would be obtained when the user is sitting quietly and not moving his jaw. As noted above, housing 52 readily seals against the canal wall.

Figure 3B:
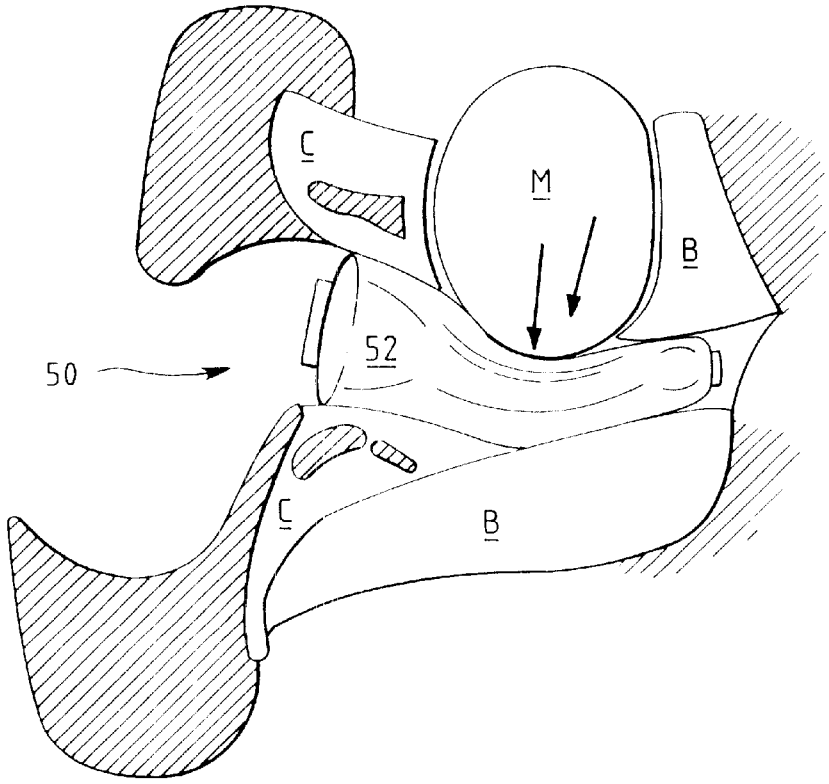
FIG. 3B is an enlarged, partial top view of the ear of FIG. 3A illustrating a changing ear canal.

FIG. 3B illustrates movement of the mandible M as the user moves his or her jaw. The mandible M moves relative to the bone B and housing 52 thereby altering the shape of the ear canal. This alteration in shape has both comfort-related and performance-related consequences. As the mandible moves, the soft compliant housing 52 deforms readily thereby continuing to fit comfortably into the canal as it dynamically changes shape. In addition, because housing 52 continues to conform to the changing shape of the canal, it maintains the seal therewith thereby minimizing external feedback between the audio output port, adjacent to wax guard 52*a* and audio input port for a microphone 52*b*.

Figure 4A:
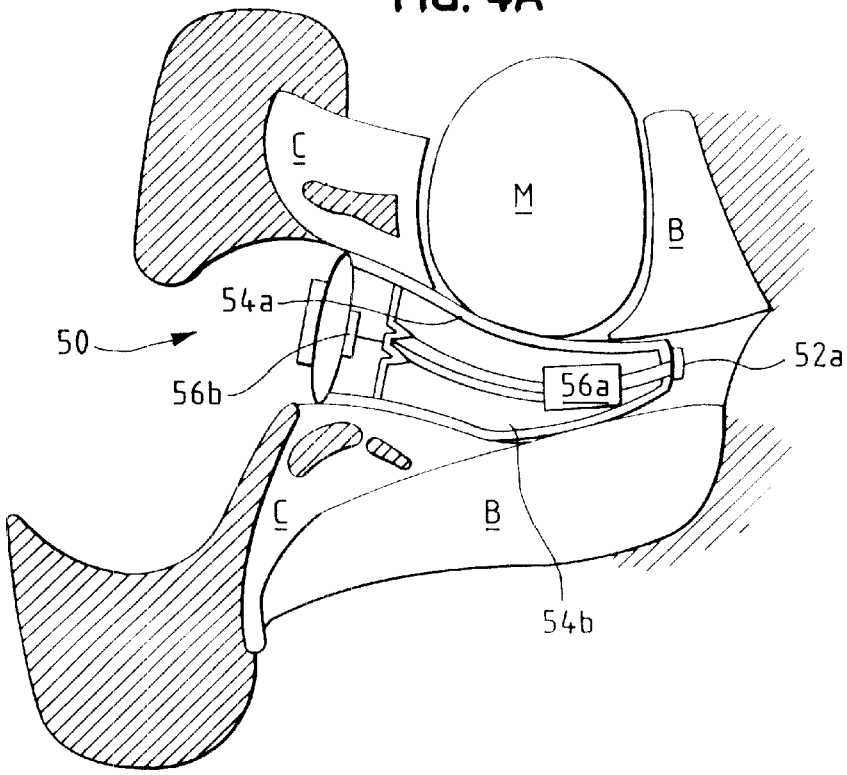
FIG. 4A is a view as in FIG. 3A with the housing of the hearing aid illustrated in section.
Figure 4B:
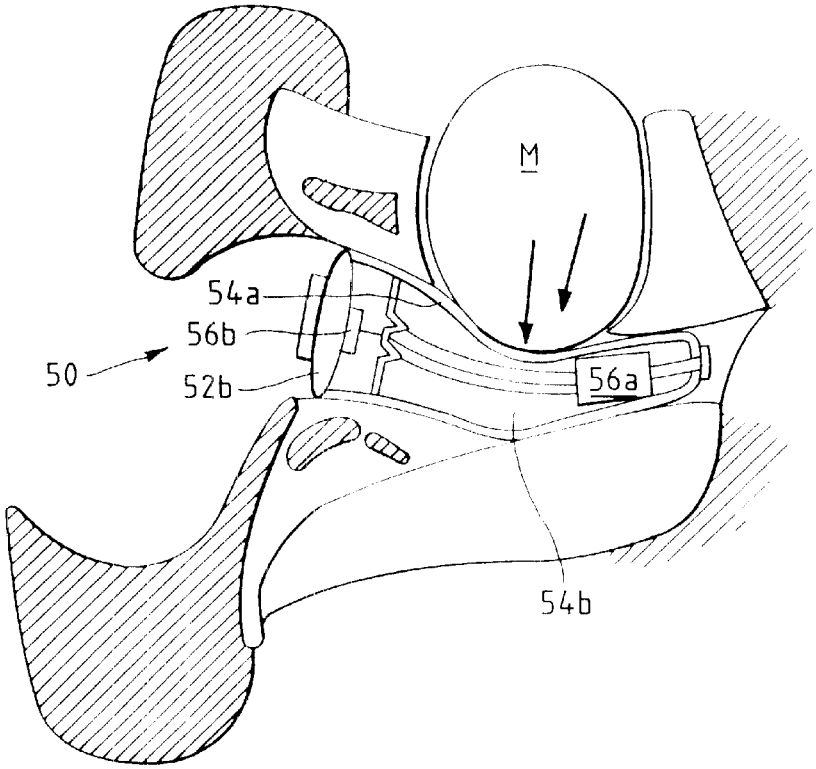
FIG. 4B is a view as in FIG. 3B with the housing of a hearing aid illustrated in section.

FIGS. 4A and 4B illustrated aid 50 in cross section in the canal. The housing 52 has an exterior shell 54*a* formed as discussed above, which surrounds an interior, compliant interior region 54*b* which is filled, except perhaps for an output transducer 56*a*, and a battery, electronics package 56*b*, with a cured elastomer as discussed above.

FIG. 4A illustrates the ear and housing 52 in a quiescent state. FIG. 4*b* illustrates deformation of housing 52 and alteration of the relationship of outer shell 54*a* relative to the receiver 56*a* in response to movement of mandible M. Thus, both comfort and performance can be enhanced with hearing aids in accordance with the present invention.

Figure 5A:
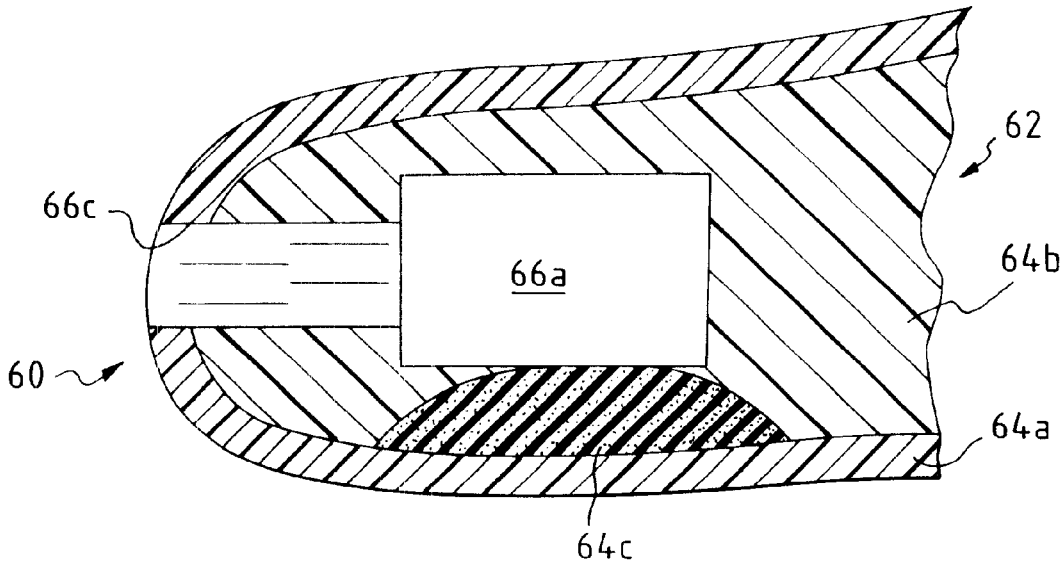
FIGS. 5A, B taken together illustrate, enlarged and in section, a portion of a hearing aid in accordance herewith.
Figure 5B:
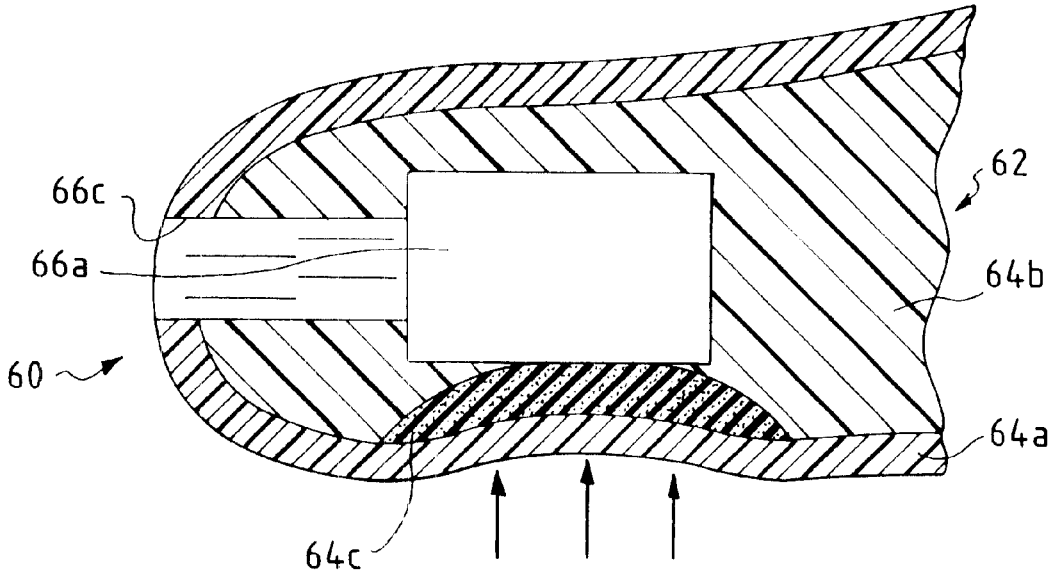

FIGS. 5A and 5B illustrate the benefits of the present invention in dealing with a user's need for a hearing aid 60 to address an anatomical problem in the ear canal. Using the present method, a soft region can be molded into housing 62 to provide a comfortable fit and a seal in a particular user's ear where an especially soft region is necessary.

Housing 62 includes an outer compliant shell 64*a*, and an interior, elastomerically filled region 64*b* as described above. Beyond that, however, foam 64*c* has been molded into the housing 62 in a selected location to provide an extra deformable region which readily deforms. It will be understood that foam 64*c* is exemplary only. Other types of fluids, such as air, or different elastomers could be used without departing from the spirit and scope of the present invention. In addition, multiple regions could be incorporated into a single housing.

Figure 6A:
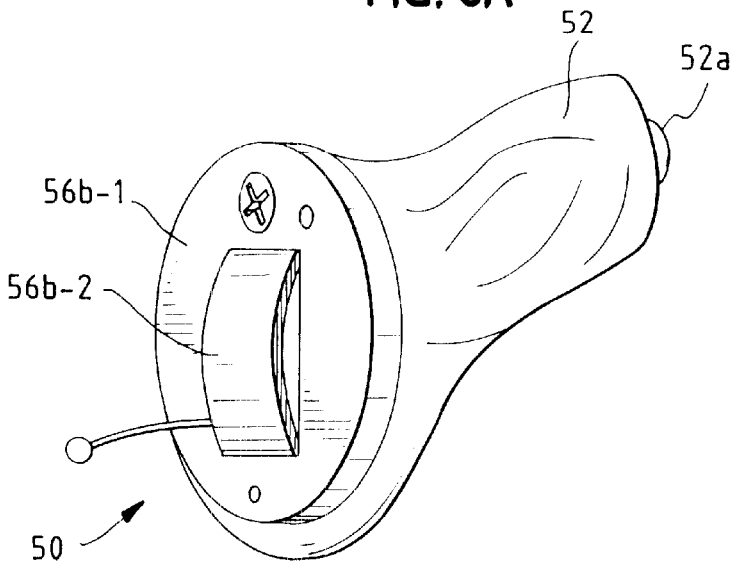
FIG. 6A is an enlarged perspective of a hearing aid in accordance herewith.

FIG. 6A illustrates the hearing aid 50 with a face plate 56*b*-1 and a battery door 56*b*-2. the face plate could for example, carry electronic package 56*b* with an associated microphone as an audio input transducer. Face plate 56*b*-1 is attached to compliant housing 52. When inserted, as described above, the housing 52 deforms to fit the user's ear canal. Face plate 56*b*-1 is adjacent to the user's outer ear after insertion.

Figure 6B:
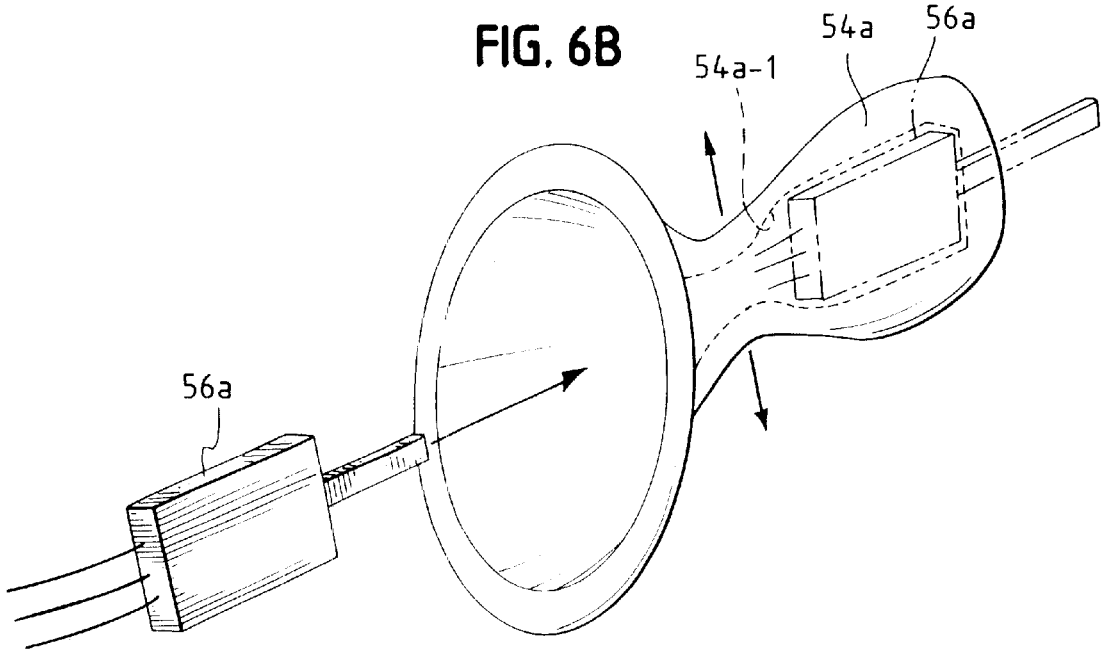
FIG. 6B illustrates deforming a shell formed in accordance herewith to insert a component therein.

FIG. 6B illustrates another advantage of hearing aid housings in accordance herewith. At times, especially in connection with completely in-the-canal hearing aids, portions of the housing may be too small to easily enable components, such as receivers, to pass into a pre-established region within the housing.

Outer shell 54*a*, as noted above, is compliant and deformable. As illustrated in FIG. 6B, a receiver 56*a* can be inserted into a component receiving region 54*a*-1 by inserting the receiver into shell 54*a*, temporarily deforming shell 54*a*. When the receiver is located in the region 54*a*-1, the shell 54*a* returns to its normal, non-distorted shape. The interior of shell 54*a* can be filled with the compliant filling material as discussed above.

Figure 7A:
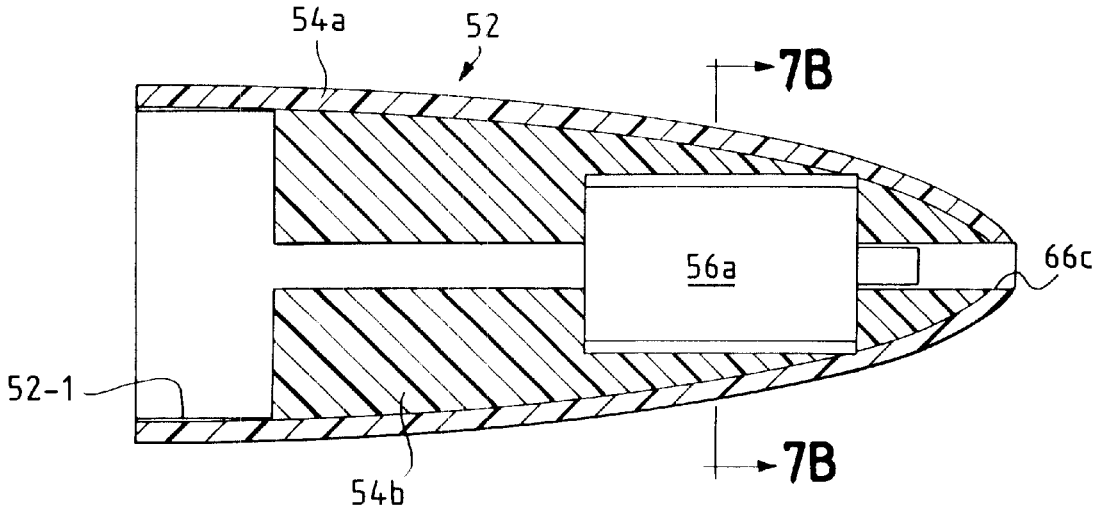
Figure 7B:
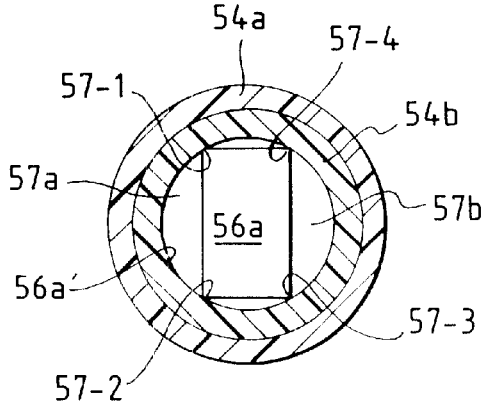

FIGS. 7A, 7B illustrate, in section, a housing 52 with compliant shell 54*a* wherein a mandrel as formed a cavity 56*a*' to receive a receiver 56*a*. Another mandrel has formed a cavity 52-1 for an electronics package and/or a battery.

Receiver 56*a* is supported only at spaced apart locations 57-1, -2, -3, -4. This support system minimizes internal feedback go the input transducer or microphone. In addition, the receiver 56*a* and microphone 52*b* can be oriented on the order to 90° out of phase to further reduce feedback. Regions 57*a*, 57*b* can be filled with a fluid, such as air or foam or other selected feedback minimizing materials.

It should be understood that the process to create a shell by making an inner and outer mold is currently required because presently available materials for making elastomeric shells are inferior. Current flexible UV or slushable materials have poor properties or undesirable process issues. One familiar with the art will understand that once UV elastomeric materials with the required properties are available, then the process of making the outer flexible shell will be simplified but the remaining steps in the process will still be valid.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A multi-material elastomeric housing for a hearing aid comprising:

a housing with an exterior periphery defined by a layer of a first deformable, elastomeric material wherein the layer of the first material deformably bounds, at least in part, an interior region with an interior surface;

a second elastomeric material which, at least in part, fills the interior region and abuts the interior surface at least in part in abutting regions wherein the second material, in the abutting regions, exhibits a corresponding male shape to that of the interior surface wherein substantial identity of the corresponding male shape of the second material and the interior surface of the layer preclude distortion of the layer by the second material, and a foam member in the interior region.

2. A housing as in claim 1 wherein the first and the second materials are the same.

3. A housing as in claim 1 wherein a third material is located adjacent to a portion of the surface.

4. A housing as in claim 3 wherein the third material comprises a fluid.

5. A housing as in claim 3 wherein the third material comprises a selected, deformable solid.

6. A housing as in claim 1 which includes a rotatable element with a shield between the element and at least the second material.

7. A housing as in claim 6 wherein the element comprises a rotatable battery door.

8. A housing as in claim 1 wherein the first and second materials are selected from a class which includes silicone, latex, polyurethane, polyvinyl.

9. A housing as in claim 8 wherein the first and second materials exhibit a hardness parameter in a range of less than 90 ShoreA.

10. A housing as in claim 1 which includes a preformed component receiving cavity therein wherein a component inserted into the cavity has a size or shape which would preclude insertion into the cavity in the absence of at least the layer temporarily deforming in response to an applied deformation force.

11. A housing as in claim 10 wherein the component is an output transducer.

12. A multi-material housing for a hearing aid comprising:

a housing with an exterior periphery defined by a layer of a first deformable material wherein the layer of the first material deformably bounds, at least in part, an interior region with an interior surface;

a second material which, at least in part, fills the interior region and abuts the interior surface at least in part in abutting regions wherein the second material, in the abutting regions, exhibits a corresponding male shape to that of the interior surface wherein substantial identity of the corresponding male shape of the second material and the interior surface of the layer preclude distortion of the layer by the abutting material; and wherein the layer is bonded to the second material only at selected locations whereby at least selected regions of the layer are movable relative to the second material.

13. A multi-material deformable housing for a hearing aid comprising:

a housing with an exterior periphery defined by a layer of a first elastomeric material wherein the layer of the first material deformably bounds, at least in part, an interior region with an interior surface;

a second elastomeric material which, at least in part, fills the interior region and abuts the interior surface at least in part in abutting regions wherein the second material, in the abutting regions, exhibits a corresponding male shape to that of the interior surface wherein substantial identity of the corresponding male shape of the second material and the interior surface of the layer preclude distortion of the layer by the abutting material; and which includes a rotatable element with a shield wherein the shield is located between the element and at least the second material.

14. A method of minimizing feedback in a user's ear wherein incident acoustic waves are processed by a hearing instrument located in the ear canal, the method comprising:

providing a hearing instrument having a deformable housing compliant enough to dynamically adjust to changes in the shape and size of the ear canal wherein the housing has a shape which corresponds, at least in part, to a portion of the ear canal;

inserting the instrument into the ear canal wherein the housing deforms on insertion, and, when inserted, blocks external feedback by sealing against adjacent regions of the ear canal when the canal is in a quiescent, non-changing state; and altering the shape of the compliant housing dynamically in response to altering the size and shape of the ear canal so as to maintain the feedback minimizing seal with the dynamically changing ear canal which includes providing a compliant layer of a first material which comprises the outer periphery of the housing, except for a selected face plate region, wherein the outer periphery has a section that abuts the adjacent regions of the ear canal with an interior formed at least in part by a compliant second material and which includes temporarily deforming at least the compliant layer while inserting a selected component therein or while removing a component.

15. A process for molding a thin walled, deformable shell for a hearing aid for a user comprising:

forming an ear impression which includes a portion having an exterior peripheral surface that replicates the user's ear canal;

forming a substantially rigid shell with a hollow interior region and with an exterior peripheral surface that duplicates at least a portion of the impression;

casting a female mold about the exterior peripheral surface of the shell;

casting a male mold of the hollow interior region;

removing the rigid shell;

positioning the male mold in the female mold so as to form a space therebetween indicative of the rigid shell;

filling the space with a curable elastomer thereby forming a hollow elastomeric shell; and curing the elastomeric shell.

16. A process as in claim 15 which includes removing the elastomeric shell from the molds; and inserting at least one of a selected component and a mandrel into the shell including temporarily deforming the shell, if needed, to position the at least one.

17. A process as in claim 16 which includes forming a rigid exterior coating about the exterior of the elastomeric shell to prevent distortion thereof; and filling the interior of the shell with a selected, curable interior elastomer.

18. A process as in claim 17 which includes, prior to the filling step, locating a selected deformable material-in the interior region adjacent to the elastomeric shell.

19. A process as in claim 18 wherein the deformable material is the same type of material as the elastomer of the shell.

20. A process as in claim 17 which includes curing the internal elastomer, and, then removing the rigid exterior coating from the exterior of the shell.

21. A process as in claim 15 which includes removing the 10 elastomeric shell from the molds; and forming a separate elastomeric male representation of the interior of the rigid shell.

22. A process as in claim 21 which includes forming component receiving pockets in the male representation.

23. A process as in claim 22 which includes using pocket defining mandrels.

24. A process as in claim 21 which includes, prior to forming the male representation, locating selected electronic components to be cast therein.

25. A process as in claim 21 which includes coupling the male representation to the elastomeric shell.

26. A process as in claim 25 which includes attaching the shell to the male representation at at least one selected location.

27. A process as in claim 26 which includes using adhesive in the attaching step.

28. An elastomeric hearing aid comprising:

a deformable housing having an external, deformable shell formed of an elastomer which has an exterior shape that corresponds to a part of a user's ear canal when the ear canal is in a first state, wherein the shell includes a second elastomer and at least one foam member and carrying at least one component in the shell whereby when the ear canal moves to a second, different state at least the first elastomer deforms but not the component thereby providing a comfortable fit for the user.

29. A hearing aid as in claims 28 wherein the first elastomer is selected from a class which includes polyurethane, silicone, polyvinyl and latex.

30. A hearing aid as in claim 28 wherein the second elastomer is selected from a class which includes polyurethane, silicone, polyvinyl and latex.

31. A hearing aid as in claim 28 wherein the foam member is carried adjacent part of the shell.

32. A hearing aid as in claim 28 wherein a plurality of foam members is carried in the shell.

33. A hearing aid as in claim 28 wherein the component comprises an audio output transducer.

34. A hearing aid as in claim 33 wherein the output transducer deforms at least the shell as it is being inserted thereinto.

35. A hearing aid as in claim 34 wherein at least the shell has been cured before inserting the transducer and wherein the shell exhibits an open proximal end into which the transducer is inserted with the shell returning substantially to its respective undistorted shape once the transducer has been positioned therein.

36. A hearing aid as in claim 35 which includes at least one internal channel which extends between the open proximal end and a component region whereupon the transducer is insertable through the channel into the region, temporarily enlarging the channel as needed to slide the transducer therethrough.

37. A hearing aid as in claim 36 wherein the transducer will not pass through the channel unless at least the first elastomer is temporarily deformed thereby.

38. A hearing aid as in claim 28 wherein at least part of the shell, adjacent to the user's ear canal, forms a feedback reducing seal with that portion of the ear canal when the ear canal is in the first state and wherein the seal is maintained by deformation of at least the shell when the ear canal moves to the second state.

39. A composite in-the-ear hearing aid comprising:

an outer bounding elastomeric periphery sized for insertion into a user's ear canal and having an audio output port; and at least one foam element carried within the periphery wherein the periphery bounds an internal region, wherein the foam element is carried in the region and wherein elastomeric material fills the remainder of the internal region at least in part and is in part in contact with the foam element.

40. A composite hearing aid comprising:

an outer bounding elastomeric periphery;

at least one foam element carried within the periphery wherein the periphery bounds an internal region, wherein the foam element is carried in the region and wherein elastomeric material fills the remainder of the internal region, at least in part, and is in part in contact with the foam element wherein the periphery includes a proximal end and a distal end, an output transducer carried within the periphery near the distal end and supported by elastomeric material also within the periphery.

41. A hearing aid as in claim 40 wherein the output transducer is supported by the elastomeric material only at discrete, spaced apart locations with one of foam, and air spaces therebetween.

42. A hearing aid as in claim 41 wherein the transducer is selectively oriented to reduce feedback.

43. A hearing aid as in claim 42 wherein the transducer is insertable throung the proximal end and positonable near the distal end only by temporarily deforming the periphery.

44. A composite in-the-ear hearing aid comprising:

an outer bounding elastomeric periphery sized for insertion into a user's ear canal; and at least one deformable foam element carried completely within the periphery wherein the periphery bounds an internal region, wherein the foam element is carried in the region and wherein deformable elastomeric material fills the remainder of the internal region, at least in part, and is in part in contact with both the deformable foam element and the outer bounding elastomeric periphery.

* * * * *